US007572990B2

(12) United States Patent
Struve, Jr.

(10) Patent No.: US 7,572,990 B2
(45) Date of Patent: Aug. 11, 2009

(54) KEYPAD OVERLAY MEMBRANE

(75) Inventor: Richard R. Struve, Jr., Cedar Rapids, IA (US)

(73) Assignee: Intermec IP Corp., Everett, WA (US)

( * ) Notice: Subject to any disclaimer, the term of this patent is extended or adjusted under 35 U.S.C. 154(b) by 145 days.

(21) Appl. No.: 11/694,541

(22) Filed: Mar. 30, 2007

(65) Prior Publication Data

US 2008/0237021 A1 Oct. 2, 2008

(51) Int. Cl.
*H01H 9/26* (2006.01)
*H01H 13/72* (2006.01)
*H01H 13/76* (2006.01)

(52) U.S. Cl. ..... 200/5 A; 200/5 R

(58) Field of Classification Search ..... 200/5 A
See application file for complete search history.

(56) References Cited

U.S. PATENT DOCUMENTS 4,066,850 A 1/1978 Heys, Jr.
4,297,044 A 10/1981 Hornberg et al.
5,201,594 A 4/1993 Adinolfi et al.
5,286,125 A 2/1994 DiGiosia
6,259,044 B1 * 7/2001 Paratore et al. ..... 200/5 A
6,644,975 B2 11/2003 Heckmann, Jr.
6,911,608 B2 * 6/2005 Levy ..... 200/5 A
2005/0139457 A1 * 6/2005 Levy ..... 200/5 A
2006/0076219 A1 * 4/2006 Levy ..... 200/5 A

* cited by examiner

*Primary Examiner*—Elvin G Enad
*Assistant Examiner*—Lheiren Mae A Anglo
(74) *Attorney, Agent, or Firm*—Shook, Hardy & Bacon LLP

(57) ABSTRACT

A keypad overlay membrane provides guidance to a user in selecting an intended key to strike and avoiding striking unintended keys. In one arrangement the overlay membrane is formed by a continuous thin-walled sheet having an outwardly-facing surface and an opposed inwardly-facing surface. Formed into the thin-walled sheet are a first array of raised members and a second array of channels. The raised member array is laid out in a configuration for positioning atop individual keys of the electronic device keypad, with the channel array located between the raised member array. Upon placing the overlay membrane onto keypad, the user can apply a sufficient inwardly directed force to one of the raised members to induce movement of the respective key underlying and aligned with the particular raised member. In another arrangement, an array of concave depressions substitutes for the raised member array and channel array.

8 Claims, 2 Drawing Sheets

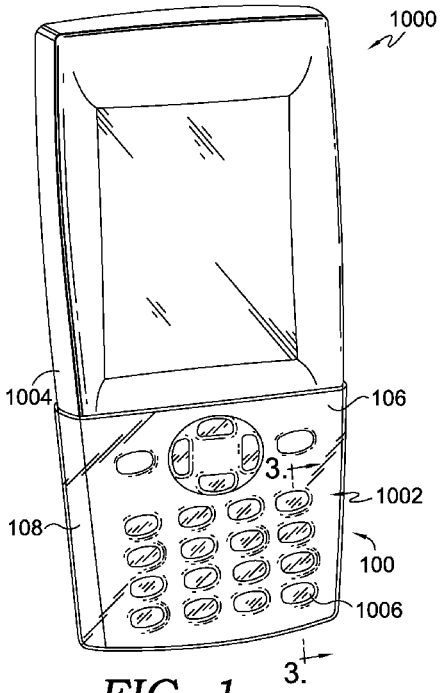
FIG. 1.
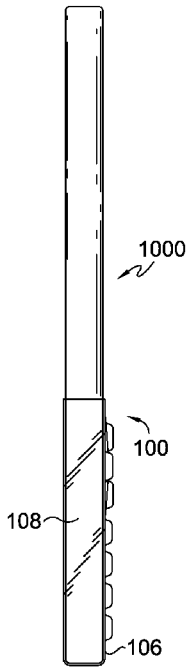
FIG. 2.
FIG. 3.
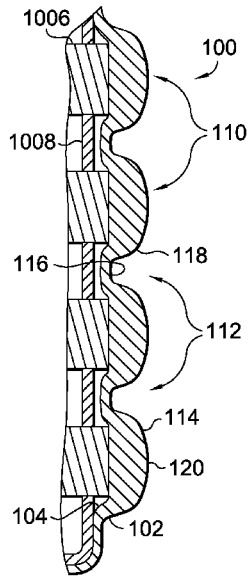
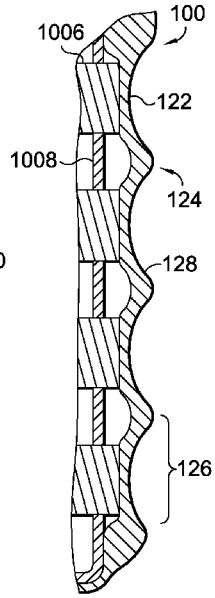
FIG. 4.

KEYPAD OVERLAY MEMBRANE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to overlay structures. More specifically, the present invention is directed to a keypad overlay membrane configured to aid the user in striking the desired input key on an electronic device.

Modern handheld electronic devices, such as cellular telephones, PDAs and other mobile computing devices, typically have a keypad interface where a user depresses individual keys to input certain information and commands. One particular limitation of most electronic device keypads is the fact that individual keys are small, with little space therebetween. As a result, a user will often strike one or more keys unintentionally when attempting to engage a particular key or sequence of keys, leading to lost time and productivity in having to make corrections. This problem is exacerbated in certain industrial or outdoor environments where a user is required to wear gloves or otherwise has reduced visibility. In the case of gloves, the user has an even more difficult time limiting keystrikes to individual keys, and reduced visibility makes it even more difficult to read the small indicia printed onto most conventional keys.

Some solutions that have been proposed for dealing with inaccurate keystrikes including adding key extensions that mount onto individual keys of a conventional keyboard. As one example, a set of projecting structural members can be attached to the keys so that the user does not have to reach as far to strike a desired key. These solutions, however, focus on large conventional keyboards, and are impractical for attachment to a small keypad of a handheld electronic device.

SUMMARY OF THE INVENTION

An overlay membrane is provided to be placed upon a keypad of a handheld electronic device to guide the user in selecting an intended key to strike and avoiding striking unintended keys. Additionally, the membrane serves as an added protection barrier for the keypad to reduce infiltration of contaminants and other debris.

In one aspect, the overlay membrane is formed by a continuous thin-walled sheet having an outwardly-facing surface and an opposed inwardly-facing surface. Formed into the thin-walled sheet are a first array of raised members and a second array of channels. The raised member array is laid out in a configuration for positioning atop individual keys of the electronic device keypad, with the channel array located between the raised member array. Upon placing the overlay membrane onto keypad, the user can apply a sufficient inwardly directed force to one of the raised members to induce movement of the respective key underlying and aligned with the particular raised member. The channel functions to not only provide a clear delineation between adjacent raised members (and thus corresponding keys underlying the raised members) but also minimize the transferring of forces from one raised member to another raised member to avoid inadvertent depression of multiple keys at once.

According to another aspect, the overlay membrane is formed by a continuous thin-walled sheet having an outwardly-facing surface and an opposed inwardly-facing surface for engaging with the electronic device keypad, as well as a first array of concave depressions formed into the sheet. The concave depression array is laid out in a configuration for positioning atop the individual keys of the electronic device keypad such that the user can apply a sufficient inwardly directed force to one of the concave depressions to induce movement of the respective key underlying and aligned with the particular depression. Optionally, a second array of bounding ridges may be formed into thin-walled sheet to surround the concave depression array. The bounding ridge array serves to guide the users input device (e.g., their finger or a stylus) in alignment with a specific concave depression to ensure that input is only applied to the intended key of the electronic device keypad.

Additional advantages and novel features of the present invention will in part be set forth in the description that follows or become apparent to those who consider the attached figures or practice the invention.

BRIEF DESCRIPTION OF THE SEVERAL VIEWS OF THE DRAWINGS

In the accompanying drawings, which form a part of the specification and are to be read in conjunction therewith and in which like reference numerals are employed to indicate like parts in the various views:

FIG. 1 is a perspective view of one embodiment of a keypad overlay membrane of the present invention, showing the membrane mounted onto a handheld electronic device keypad;

FIG. 2 is a side view of the keypad overlay membrane of FIG. 1;

FIG. 3 is an enlarged sectional view of one embodiment of a keypad overlay membrane taken along line 3-3 of FIG. 1, showing the placement of the membrane over the handheld electronic device keypad;

FIG. 4 is an enlarged sectional view of another embodiment of a keypad overlay membrane taken along line 3-3 of FIG. 1, showing the placement of the membrane over the handheld electronic device keypad;

DETAILED DESCRIPTION OF THE INVENTION

Figure 5:
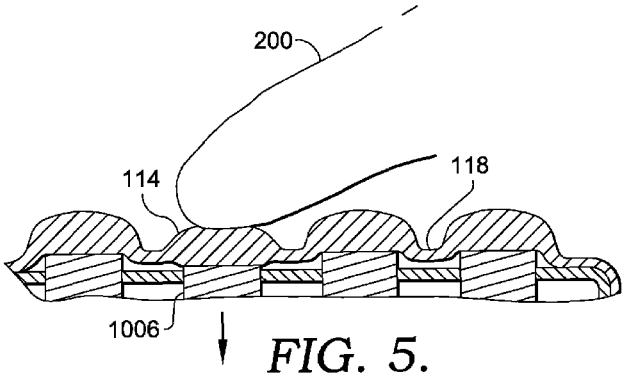
FIG. 5 is a view of the embodiment of the keypad overlay membrane of FIG. 3, showing a glove finger engaging the membrane.

Various embodiments of a keypad overlay membrane of the present invention enable a user to more readily engage an intended key of a handheld device keypad. Accordingly, the keypad overlay membrane reduces the opportunity for unintended multiple keystrikes when providing input to a handheld device through the keypad.

With initial reference to FIGS. 1 and 2, an embodiment of a keypad overlay membrane 100 is shown mounted onto a handheld electronic device 1000. The membrane 100 can be utilized with a wide variety of handheld electronic devices, such as mobile computing devices or the like (e.g., cellular telephones, PDAs, etc.). The membrane 100 has an outwardly-facing surface 102 that is engaged by the user and an inwardly-facing surface 104 engaging the device 1000. A first primary section 106 of the membrane 100 directly overlies a keypad section 1002 of the device 1000, and a set of opposed secondary side extensions 108 engaging with sidewalls 1004 of the device 100. Additionally, the membrane 100 may be formed into a sleeve-type configuration for sliding over and surrounding a portion of the device 1000 at the location of the keypad section 1002. As explained in more detail herein, regardless of the particular configuration, the membrane 100 provides certain features to enable the user to more easily depress a desired key 1006 of the keypad section 1002 while also being configured to reduce the tendency of the applied force by the user traveling across the membrane 100 (and across a keypad frame 1008 surrounding the keys 1006) to adjacent keys 106.

Preferably, the keypad overlay membrane 100 is formed of a nonporous, transparent or translucent plastic thin-walled sheet material (e.g., a urethane or any other type of polymer) so that the user can see the indicia present on individual keys 1006 of the device 100 in the keypad section 1002. Alternatively, indicia may be formed the membrane 100 itself to correspond with the indicia on the individual keys 1006 or indicia generally on the keypad section 1002, whereby the membrane 100 need not be mostly or fully transparent, or in situations where the visibility of the user may be impaired (e.g., when the device is used in an environment with lots of debris and/or the user is required to wear facegear, such as goggles or a protection suit). The material of the membrane 100 also inhibits the infiltration of debris and other matter into the keypad section 1002.

Turning to FIGS. 3 and 5, one embodiment of the keypad overlay membrane 100 includes a first array of raised members 110 surrounded by a second array of channels 112. The raised member array 110 is configured to be positioned on top of the keypad section 1002 of the device 1000 such that individual raised members 114 of the array 110 are aligned with individual keys 1006 of the keypad section 1002. In this configuration, the membrane 100 acts to add additional height to keys 1006 by introducing a key engaging structure with a larger dimension outwardly from the device 1000 (measured from a base 116 of an individual channel 118 of the channel array 112 to a peak 120 of one of the raised members 114) than the outward dimension or height of one given key 1006 of the keypad section 1002 from the keypad frame 1008 surrounding the respective key 1006. This enables the user to better visualize the distinction between individual keys 1006 through the raised members 110. A portion of the membrane 100 where the raised member array 110 is located provides a more substantial material thickness than another membrane portion where the channel array 112 is located. Not only does this provide the user with a strong visual distinction between adjacent raised members 114, but also ensures that individual raised members 114 have an overall stiffness that is greater than the stiffness of adjacent individual channels 118. The increased stiffness reduces the tendency of forces applied to the membrane 100 by a user's finger 200 from traveling laterally across the membrane 100 through the channel array 112 to reach adjacent raised members 114, which might engage individual keys 1006 of the device 1000 that were not meant to be engaged. It should be understood that different types of material (or structural stiffeners) may be also be employed in the portion of the membrane 100 where the raised member array 110 is formed in contrast to the portion of the membrane 100 where the channel array 112 is formed, to affect the stiffness values.

Figure 6:
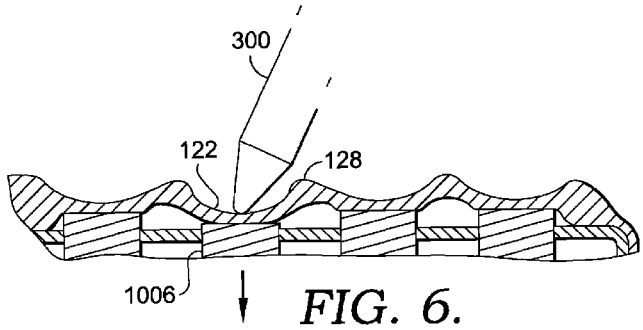
FIG. 6 is a view of the embodiment of the keypad overlay membrane of FIG. 4, showing a stylus engaging the membrane.

In another embodiment depicted in FIGS. 4 and 6, the keypad overlay membrane 100 includes a first array of concave depressions 121 that substitute for the raised member array 110 of the embodiment of the membrane 100 shown in FIG. 3. Similar to the previous embodiment, the concave depression array 121 is configured to be positioned on top of the keypad section 1002 of the device 1000 such that individual depressions 122 of the array 121 are aligned with individual keys 1006 of the keypad section 1002. Instead of addition additional height to the keys 1006, the depression array 121 seeks to guide a user's input device (e.g., user's finger 200 or a stylus 300) into the concavity of the selected depression 122, so that as an inward force is applied, such a force is focused in a base of the depression 122 directly overlying a specific key 1006 of the device keypad section 1002. Surrounding the depression array 121 is a raised region 124 to delineate the individual depressions 122. Accordingly, the raised region 124 may be formed as an array of bounding ridges 126 that overlie the keypad frame 1008 surrounding the keys 1006 of the keypad section 1002. Furthermore, the portion of the membrane 100 where the bounding ridge array 126 is located provides a more substantial material thickness than another membrane portion where the depression array 121 is located. Thus, the depression array 121 has an overall stiffness that is less than the bounding ridge array 126. This is beneficial because the user's input device will not be able to easily force an engaged bounding ridge 128 of the array 126 into an adjacent key 1006 that is not intended to be depressed when a give depression 122 is not directly struck. Further, when the depression 122 is actually directly struck (e.g., at the base of the depression 122), those forces will transfer most directly to the particular key 1006 directly underlying the struck depression 122 because of the increase flexibility of the depression 122 as compared to the adjacent bounding ridge 128.

As can be appreciated, the embodiments of the keypad overlay membrane guide the user in selecting an intended key to strike and avoiding striking unintended keys on a handheld computing device. Since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

What is claimed is:

1. An overlay membrane for a keypad of a handheld electronic device, the keypad having a plurality of individual keys surrounded by a frame, the overly membrane, comprising:

a continuous thin-walled sheet having an outwardly-facing surface and an opposed inwardly-facing surface for engaging with the electronic device keypad; and an array of concave depressions formed into the thin-walled sheet in a configuration for positioning atop the plurality of individual keys;

an array of bounding ridges surrounding the array of concave depressions, wherein the bounding ridges are formed into the thin-walled sheet in a configuration such that the bounding ridges are aligned with and positioned atop a portion of the keypad frame where the plurality of individual keys are not located when the array of concave depressions are positioned atop the plurality of individual keys, enabling application of a sufficient force to one of the depressions to induce movement of a respective first individual key of the plurality of individual keys of the keypad underlying and aligned with the particular depression.

2. The overlay membrane of claim 1, wherein the array of bounding ridges provide the thin-walled sheet with a particular stiffness at the location of the ridges that is increased from the stiffness of the thin-walled sheet at some portion of the location of the array of concave depressions.

3. The overlay membrane of claim 1, wherein a first portion of the thin-walled sheet where the array of concave depressions are formed has a decreased thickness over at least some portion of the remainder of the thin-walled sheet.

4. The overlay membrane of claim 1, wherein the thin-walled sheet is nonporous.

5. The overlay membrane of claim 1, wherein the thin-walled sheet is one of transparent or translucent.

6. The overlay membrane of claim 1, wherein the thin-walled sheet is formed from one or more plastics.

7. The overlay membrane of claim 1, wherein the thin-walled sheet includes a pair of opposed side extensions for engaging with a set of sidewalls of the electronic device.

8. The overlay membrane of claim 1, wherein the inwardly-facing surface of the thin walled sheet is formed with concavities disposed beneath the array of bounding ridges.

* * * * *